US005821445A

United States Patent [19]

Guhring

[11] Patent Number: 5,821,445

[45] Date of Patent: Oct. 13, 1998

[54] LOADING LEVER ASSEMBLY FOR HAND-OPERATED FIREARMS

[75] Inventor: Manfred Guhring, Oberndorf-Beffendorf, Germany

[73] Assignee: Heckler & Koch GmbH

[21] Appl. No.: 835,438

[22] Filed: Apr. 9, 1997

[30] Foreign Application Priority Data

Apr. 9, 1996 [DE] Germany ..... 196 13 987.2

[51] Int. Cl.[6] ..... B64D 17/22

[52] U.S. Cl. ..... 89/1.42; 42/16

[58] Field of Search ..... 89/1.42; 42/16

[56] References Cited

U.S. PATENT DOCUMENTS

| | | | |
|---|---|---|---|
| 837,072 | 12/1906 | Johnson | 42/16 |
| 2,383,471 | 8/1945 | Colby | 89/27 |
| 3,365,830 | 1/1968 | Vartainian et al. | 42/16 |
| 3,797,153 | 3/1974 | Hagan | 42/27 |
| 3,813,803 | 6/1974 | Eder et al. | 42/16 |
| 4,888,902 | 12/1989 | Knowles | 42/90 |
| 5,214,233 | 5/1993 | Weldle et al. | 89/1.4 |

FOREIGN PATENT DOCUMENTS

GM 69 01 830 1/1969 Germany .

*Primary Examiner*—Charles Jordan
*Assistant Examiner*—Meena Chelliah
*Attorney, Agent, or Firm*—Leydig, Voit & Mayer, Ltd.

[57] ABSTRACT

A loading lever assembly for a hand-operated firearm has a loading lever which can be pivoted from a released position in which it lies in the longitudinal direction of the weapon to an end-of-swing position on either side of the weapon. The lever is pivotally connected to a mounting strip on the breech block carrier by means of an oblong slot formed in an end of the loading lever and a pivot pin on the mounting strip. The oblong slot allows the lever to be moved from an end-of-swing position to an operation position in which the loading lever engages two end stops on the mounting strip to prevent the lever from swinging forward or rearward. A spring-loaded cam arrangement provides the restoring force for returning the lever to the released position from the end-of-swing positions.

10 Claims, 3 Drawing Sheets

LOADING LEVER ASSEMBLY FOR HAND-OPERATED FIREARMS

FIELD OF THE INVENTION

This invention relates generally to the weaponry art, and more particularly to a loading lever assembly for moving a breech block or breech block carrier in a hand-operated firearm.

BACKGROUND OF THE INVENTION

In automatic weapons or submachine guns, it is common to rigidly mount a loading lever on the breech block or breech block carrier of the weapon. Such a loading lever typically projects laterally from the weapon housing a significant length and therefore protrudes outwardly from over the outer contour of the weapon. An example of a weapon with this type of loading lever is the Soviet AK 47. This construction has the advantage of relatively low manufacturing cost. The rigid connection of the loading lever to the breech block also allows the user to move the breech block not only in an opening direction but also in a closing direction. Thus, the user can apply a force by hand, in addition to the restoring force from the closing spring, to urge the breech block into its closing position.

The advantages of this construction are, however, generally outweighed by the disadvantage that the loading lever, which protrudes outwardly from the side of the weapon, follows the violent back and forth movement of the breech block during a firing operation. The loading lever can easily catch the cover or equipment of the user, thereby causing jamming of the weapon. There is also the possibility that the user may be unintentionally injured by the violent movement of the loading lever.

Another disadvantage of this construction results from the positioning of the loading lever since it typically projects through the cartridge shell ejecting window on the right of the weapon. In order to operate the lever, the user is required to remove his right hand from the grip of the weapon. In the event that a cartridge becomes jammed and must be removed by manually loading the weapon, the time required for the loading operation becomes relatively long, and the user is rendered defenseless during that period of time.

Various attempts have been made in the past to remedy these shortcomings. For example, it is known to mount a loading lever on the left side of a rifle over its hand guard. An example of this type of rifle is the G 3 model used by the German Federal Armed Forces. The loading lever in this arrangement is separable from the breech block. During the loading operation, the loading lever engages the breech block from behind and moves it to the rear. Thereafter the loading lever is released and returns to its initial position where it remains during the shooting process, while the breech block moves in the usual manner.

One disadvantage of this arrangement is that the loading lever cannot be used to apply any force in the closing direction of the breech block. That is, the force of closing spring is not sufficient to urge the breech block completely into its closed position, the user cannot use the loading lever to assist the closing. For example, in loading the above mentioned G 3 rifle, if the user does not release the breech block abruptly to allow the breech block to dart forward, but instead guides it forward slowly to avoid a loud loading noise, the force of the closing spring may be insufficient to completely close the locking mechanism. In order to remedy this disadvantage, the breech block carrier of that weapon has been provided with a relatively flat auxiliary hand grip which slightly overhangs the side of the weapon. When the closing spring is incapable of moving the breech block into its proper closed position, this hand grip can be pressed forward to close the locking mechanism.

This arrangement, however, is inconvenient for left-handed user. That is, a user who holds the rifle in the usual way, namely with his right hand on the grip, can operate the loading lever directly with his left hand. On the other hand, a left-handed user who holds the grip with his left hand has to release the grip in order to operate the loading lever.

Further attempts to avoid the disadvantages mentioned above include, for example, reducing the length of a loading lever which is rigidly mounted on the breech block, or omitting it entirely by replacing it with a grip hole in the breech block. An example of the latter approach is a U.S. made submachine gun known as the M2 or "Grease Gun," which is no longer in use.

Alternatively, it has been proposed to replace the loading lever with a trigger-like lever which projects from the upper side of the weapon housing. This lever is arranged to be protected by a hand grip and thus lies within the outer contour of the weapon. An example of this type of weapon is the French rifle model FA MAS F3. The placement of the loading lever under the hand grip for protection is not entirely satisfactory because the loading lever can be accessed with only one finger, and therefore often cannot be operated with sufficient force. Moreover, even in the protected position, the movement of the loading lever can still be hampered, for example, by camouflage material that is attached to or laid on the weapon.

Perhaps the most favorable solution known to date is the novel loading arrangement disclosed in German Patent DE 39 28 125 A1, which was also invented by the applicant of this invention. This arrangement has a flat strip on which a loading lever is mounted. The strip is firmly connected to the breech block carrier with the use of form closure or force closure, and extends along the shooting direction of the weapon. The strip protrudes upwardly through a central oblong slot formed on the upper side of the weapon housing. A loading lever provided as a short, sturdy, rod has one end pivotally mounted on a vertical pivot disposed on the front end of the strip.

One advantage of this arrangement is that the loading lever only slightly projects beyond the contour of the weapon housing when it is in a released position in which it is aligned in the shooting direction of the weapon. When the lever is located under a hand grip, it lies entirely inside the contour of the weapon. The loading lever assumes this position during the firing operation of the weapon and moves back and forth with the breech block. An additional advantage of this arrangement is that the loading lever is always in the field of vision of the user. Thus, after a shot, the user can immediately determine whether the weapon is jammed from the position of the loading lever.

During a loading operation, the loading lever is grasped by a finger of the user and swung to the right or left of the weapon, depending on the hand used, until it hits a stop. In that position, the lever extends at a right angle with respect to the shooting direction and can be grasped with several fingers to pull it toward the rear of the weapon. To apply a force in the closing direction on the breech block or breech block carrier, the lever can be grasped by the fingers of the user and pushed forward. When the lever is released, a restoring spring provides the force to urge the loading lever back to the released position and keeps it there during shooting operation.

Another problem known to automatic weaponry is when a cartridge in the cartridge chamber of the weapon becomes jammed before it reaches the loaded position, thereby causing malfunction of the weapon. The jammed cartridge may be caused, for example, by the existence of sand in the cartridge or by a deformed cartridge. When a cartridge becomes jammed, removal typically requires a great force to be exerted on the loading lever, particularly when the user does not have a suitable tool and does not have the opportunity to disassemble the weapon.

In some cases it is possible to attempt to open the breech block to unload the cartridge by, for example, applying a large force such as a boot kick to the loading lever. This approach, however, often does not work because the extractor claw may slip from the complemental groove formed in the cartridge, and, as a result, the cartridge will remain jammed in the cartridge chamber.

A more effective measure to remove a jammed cartridge is to try to close the breech block violently to force the cartridge into the loaded position. The cartridge can then be fired and generally the cartridge shell can be ejected, and the weapon will again be operable.

Nevertheless, some weapons, such as the G 3 rifle mentioned above, do not allow such a measure for removal of the jammed cartridges. In such a case, it is necessary to avoid the causes of jamming as much as possible. For instance, it has been proposed to use a cartridge chamber with longitudinal grooves in which the dirt deposited in the groove can be blown away by the combustion gas after each shot. Alternatively, service instructions may be provided to prohibit the use of damaged ammunition, such as cartridges that have already caused prior jamming conditions.

Overall, however, the existing art has not provided satisfactory solutions to the above described problems associated with loading levers, even though automatic hand-operated automatic firearms with loading levers have been in military use for nearly 80 years, and those problems have been recognized by those skilled in the art for just as long.

SUMMARY OF THE INVENTION

Accordingly, it is an object of the present invention to provide a loading lever arrangement that more effectively addresses the above-described difficulties than was hitherto possible in the described state of the art.

The present invention meets this and other objects with a loading lever assembly disposed to enable manual movement of a breech block or breech block carrier of a hand-operated firearm. The loading lever assembly comprises a mounting member which is attached to the breech block. The mounting member protrudes through an opening formed in the upper portion of the weapon housing. A loading lever has a pivot end pivotally mounted on the mounting member that permits pivotal swinging movement in a released position. In this position, the loading lever extends in the longitudinal direction of the firearm. The loading lever can then be pivoted to either a first or second operable position in which the lever extends substantially transversely to the shooting direction of the firearm. A restoring element provides a restoring force to urge the loading lever toward its released position. The mounting member also has two end stops formed thereon for blocking the swinging movement of the loading lever on, respectively, the left and right sides of the firearm. The loading lever assembly includes a detent operable to restrict swinging movement of the loading lever when the loading lever is in either the first or second operable position.

Other objects and advantages will become apparent with reference to the following detailed description when taken in conjunction with the drawings in which:

Figure 1:
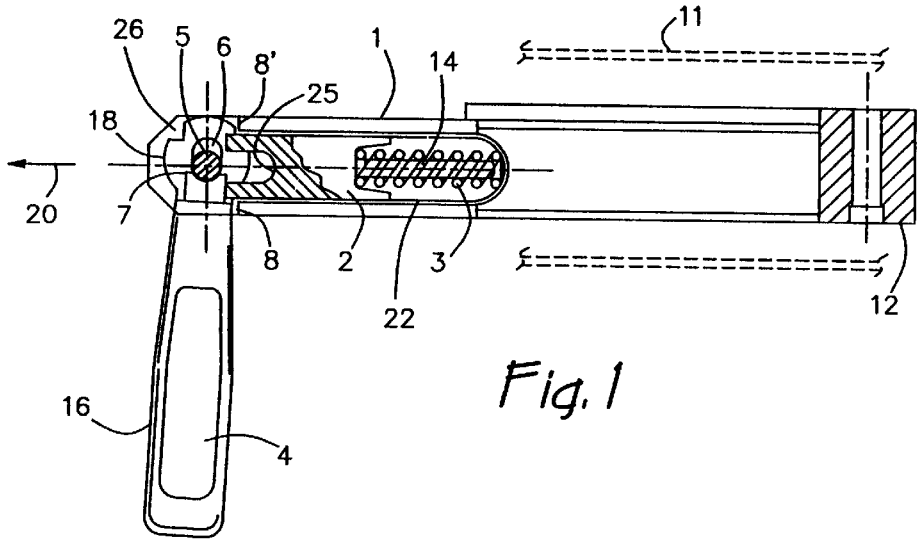
FIG. 1 is a top plan view of a loading lever assembly according to the present invention in an operable position.

While the invention is susceptible of various modifications and alternative constructions, certain illustrated embodiments hereof have been shown in the drawings and will be described below. It should be understood, however, that there is no intention to limit the invention to the specific forms disclosed, but, on the contrary, the intention is to cover all modifications, alternative constructions and equivalents falling within the spirit and scope of the invention as defined by the appended claims.

DETAILED DESCRIPTION OF THE PREFERRED EMBODIMENT

Generally, the present invention relates to a loading lever assembly that includes a mounting strip, a loading lever pivotally mounted thereto, and a pair of stops that selectively abut the lever to retain it in either first or second operable positions. The invention is intended for used in a hand-operated firearm.

Turning now to the drawings, FIGS. 1–6 show a loading lever assembly according to the invention, but with the loading lever at different positions. The loading lever assembly is used in a weapon for moving the breech block carrier along a shooting direction (the longitudinal direction) of the weapon. In the drawings, the shooting direction of the weapon is indicated by the arrow 20 shown in FIG. 1. In the interest of clarity of illustration, the housing 11 and the breech block carrier 12 of the weapon are only shown schematically in FIG. 1.

In accordance with the invention, the loading lever assembly comprises a loading lever 4 which is pivotally mounted to a mounting member 1. The mounting member 1 is secured to the breech block or breech block carrier of the weapon. In the illustrated embodiment, the loading lever assembly is disposed on the top side of the weapon housing. The mounting member is in the form of a longitudinally extending strip 1. The strip 1 is formed on or firmly mounted to the breech block carrier and passes through an opening formed in the upper side of the weapon housing. The strip 1 moves back and forth (in the direction of arrow 20) together with the breech block carrier during shooting operation.

At one end of the longitudinal strip 1 is mounted a vertical pivot pin 5 which is located along the center-line of the weapon. On the rear side of the pivot pin 5 is a horizontal guide 22 in which a pusher element 2 is received and guided for sliding movement in the forward and backward directions. The pusher element 2 has a rearward-oriented spring-guide rod 14 on which a helical pressure spring 3 is seated. The rear end of the spring 3 is supported against the rear end surface of the guide 22.

The loading lever 4 has a generally elongate shape with a grip end 16 adapted for ready gripping engagement by the fingers of a user and a pivot end 18 which is mounted to the pivot pin 5. The pivot end 18 has a bearing bore formed therein through which the pivot pin 5 passes. In accordance with the illustrated embodiment of the invention, the bearing bore is constructed as an oblong slot 6 extending in the lengthwise direction of the loading lever 4.

Figure 2:
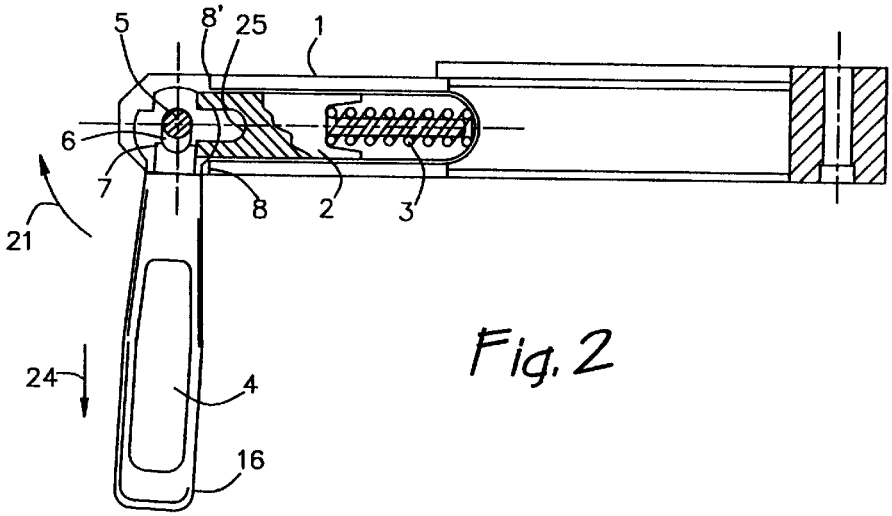
FIG. 2 is a top plan view similar to FIG. 1 but with the loading lever moved from the operable position.
Figure 3:
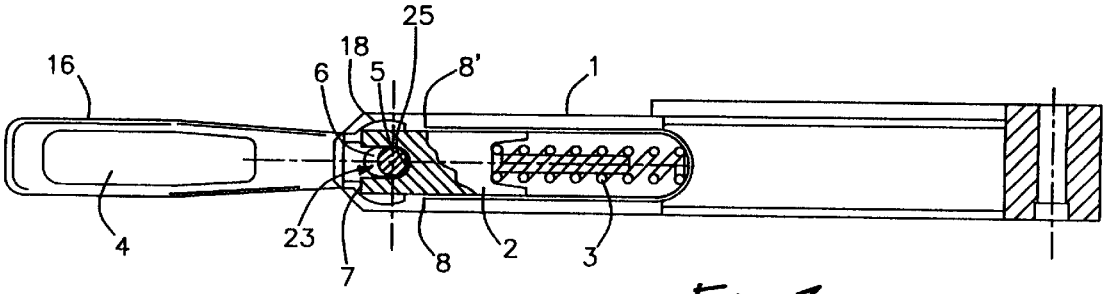
FIG. 3 is a top plan view similar to FIG. 2 but with the loading lever in a released position.
Figure 5:
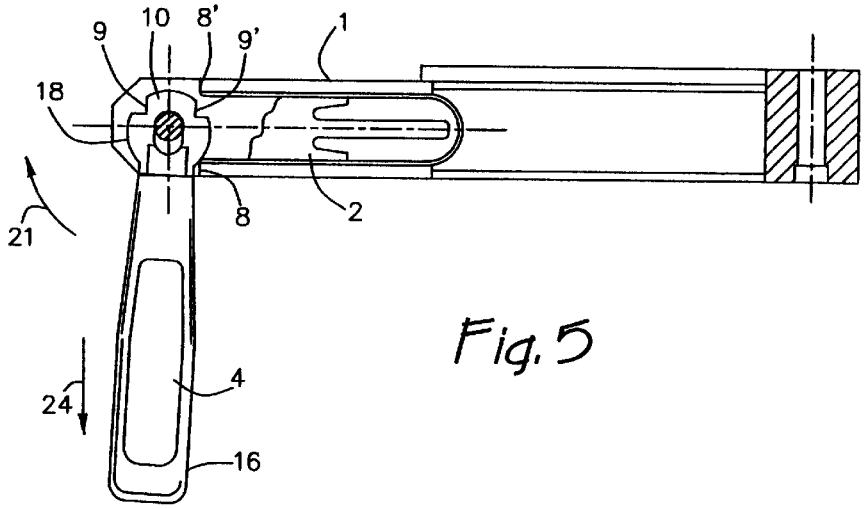
Figure 6:
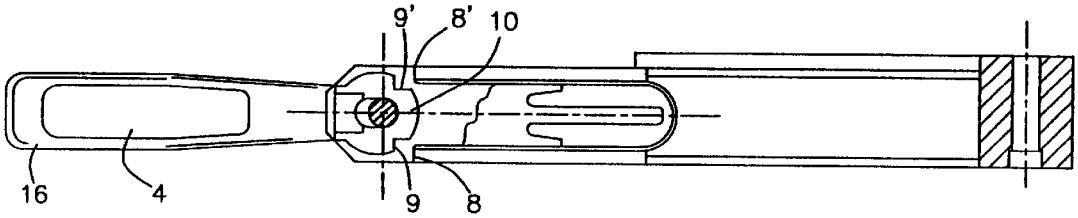

The pivotal connection between the strip 1 and the loading lever 4 permits the loading lever to be moved in a horizontal plane from a released position, which is shown in FIGS. 3 and 6, toward either the left or right side of the weapon. In FIGS. 2 and 5 the loading lever is shown at an end-of-swing position on the left side of the weapon. The end-of-swing position on the right side is a mirror image of that on the left side. In either end-of-swing position the loading lever 4 extends substantially perpendicularly to the shooting direction of the weapon. Due to the general symmetry of the positions of the loading lever on the left and right sides of the weapon, the operation of the lever with respect to the left side will be described in greater detail below.

The loading lever 4 has a saddle-shaped cam member 7 disposed on the horizontal level of the pusher element 2. The cam member 7 has a central recess 23 matching the contour of the oblong slot 6. The pusher element 2 likewise has a central notch 25. The ends or legs of the pusher element 2 facing the loading lever is constructed in the form of a gable. When the loading lever 4 is oriented in the longitudinal position shown in FIG. 3, the two end surfaces of the gable-shaped legs of the pusher element 2, under the pressure of the restoring spring 3, are seated in abutment with the end surfaces of the cam member 7 on the two sides of the recess 23. In this position, the recess 23 of the cam member 7 and the notch 25 of the pusher flank the oblong slot 6 without overlapping its contour.

When the loading lever 4 is rotated or swung, for example in the left direction from the longitudinal released position shown in FIG. 3, the left side of the saddle-shaped cam member 7 acts on the left end of the face surface of the pusher element 2 to urge it back against the force of the restoring spring 3 until the left end-of-swing position of the lever shown in FIG. 2 is reached. If the loading lever is released, it will rotate or swing in the direction of the arrow 21 under the force of the restoring spring 3 until it returns to the released position in FIG. 3 and remains in that position under the pressure from the pusher element 2.

Figure 4:
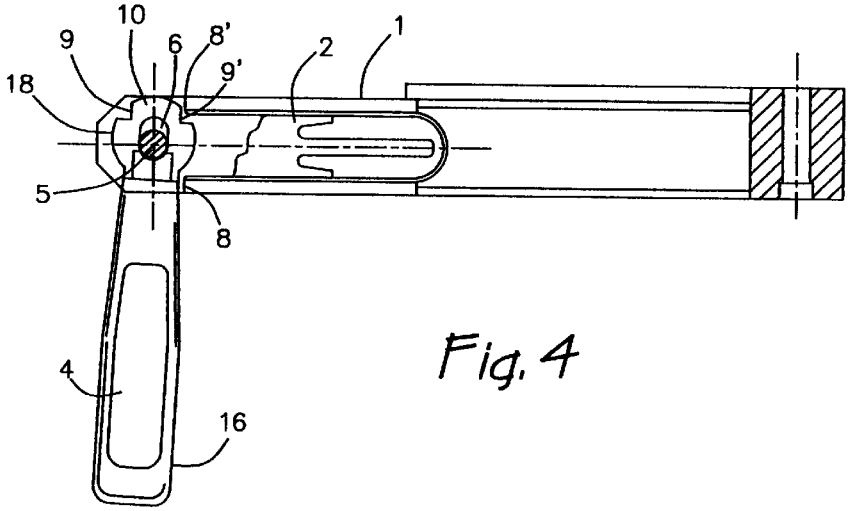
FIGS. 4, 5, and 6 are top plan views generally corresponding to FIGS. 1, 2, and 3, respectively, but with a portion of a pusher removed to reveal a detent mechanism according to the invention.

In accordance with a feature of the invention, the loading lever assembly includes a detent mechanism which prevents the lever 4 from returning to the released position (FIG. 3) when the lever is placed into an operation position on either the left or right side of the weapon. An embodiment of the detent mechanism is shown in FIGS. 4–6. With the aid of the detent mechanism, the loading lever 4 is retentively engaged in either of its first or second operating positions as if it were rigidly mounted on the longitudinal strip 1.

More particularly, the oblong shape of the slot 6 allows the lever 4 to be moved in its longitudinal direction relative to the pivot pin 5. A generally circular-disk shaped latch member 26 is formed on the pivot end 18 of the lever 4 on a horizontal plane that is different from that of the cam member 7. The oblong slot 6 is formed such that the curved end surface of the slot away from the grip end 16 of the loading lever is concentric with the circular edge of the latch member 26. The latch member 26 has a pair of notches formed thereon that interrupt the circular form of the disk to form a projection 10 and two side flanks 9, 9'.

When the loading lever is located at either one of its end-of-swing positions (such as the left end-of-swing position shown in FIG. 5), it can be thrust in its lengthwise direction, transverse to the shooting direction of the weapon, toward the mounting strip 1 as far as the oblong slot 6 permits to reach an operation position (such as the left operation position shown in FIG. 4). In the operation position, a side of the lever 4 abuts an end stop 8 or 8' formed on the strip, thereby preventing the lever from pivoting further toward the rear of the weapon. By virtue of the sliding movement made possible by the oblong slot 6, one of the side flanks 9, 9' engages the second end stop 8' or 8 on the strip. This second end stop serves as a counter-stop to prevent the lever from being counter-rotated or pivoted toward the shooting direction or front end of the weapon. In this way, the projection 10 is used as a blocking bolt which is slid into a bolting position when the lever 4 is moved from the end-of-swing position to the operation position.

Since in either of the left and right operation positions the lever bears against both end stops 8 and 8' and therefore can not be pivoted forward or rearward, it is supported for transferring force to the breech block carrier. The user can then apply forces on the grip end of the lever by pounding, pressing, etc., until the breech block carrier reaches the desired position. In this regard, the restoring spring 3 applies a force on the pusher element 2 against the cam member 7 to apply a torque which urges the loading lever toward the released position. The torque causes the end stop 8 or 8' which acts as a counter-stop to properly engage the corresponding side flank 9 or 9' of the latch member, thereby preventing the loading lever 4 from slipping out of the operation position.

Because the loading lever 4 is latched in the operation position, it can be acted upon with very high forces like a conventional loading lever rigidly mounted on the breech block.

Moreover, in sharp contrast to known swingable loading lever arrangements in which the loading lever tends to return to the longitudinal position unless it is held by the hand of the user, the loading lever of this invention can be securely detented in the operation position. It is therefore possible to move the breech block in either forward or rearward direction by applying blows without having to hold the loading lever in the swung-out position by hand to overcome the force of the restoring spring. A rifle equipped with the loading lever arrangement of this invention is therefore as easy to operate and safe to handle as a rifle equipped with the know swingable loading lever, but allows effective removal of malfunctions like a rifle with a loading lever rigidly mounted on the breech block. The invention thus combines the opposing principles of a "rigidly mounted loading lever" and a "non-rigidly mounted loading lever" in a novel and highly effective manner.

The detent mechanism is preferably constructed such that it can be easily released so that the loading lever can be released from the latched position by the violent movement of the breech block during firing and then automatically return to the longitudinal position. This feature is especially important in situations where the user of the weapon is compelled to fire before he can release the loading lever from the operation position.

This consideration is effectively addressed by the loading lever assembly of the invention. To release the loading lever 4 from the operation position, it is only necessary to pull lightly on the loading lever away from the mounting strip 1 (i.e., in the direction of the arrow 24 in FIG. 2 or FIG. 5)

until the end of the oblong slot 6 closest to the projection 10 engages the pivot pin 5. The lever 4 is now in the end-of-swing position and can be swung back by the force of the restoring spring 3 to the released position. The circular contour of the projection 10 ensures that it will not be caught by the end stop 8 or 8' when the lever is pivoted toward the released position.

If the weapon is inadvertently fired when the lever 4 is latched in an operation position, then in the course of the reloading process the detent mechanism will be subjected to high acceleration and inertial forces. The acceleration and inertial forces counteract against the restoring spring 3 to cause the loading lever 4 to be jolted out of the operation position. The lever 4 is then allowed to return to its released position shown in FIGS. 3 and 6.

Figure 7:
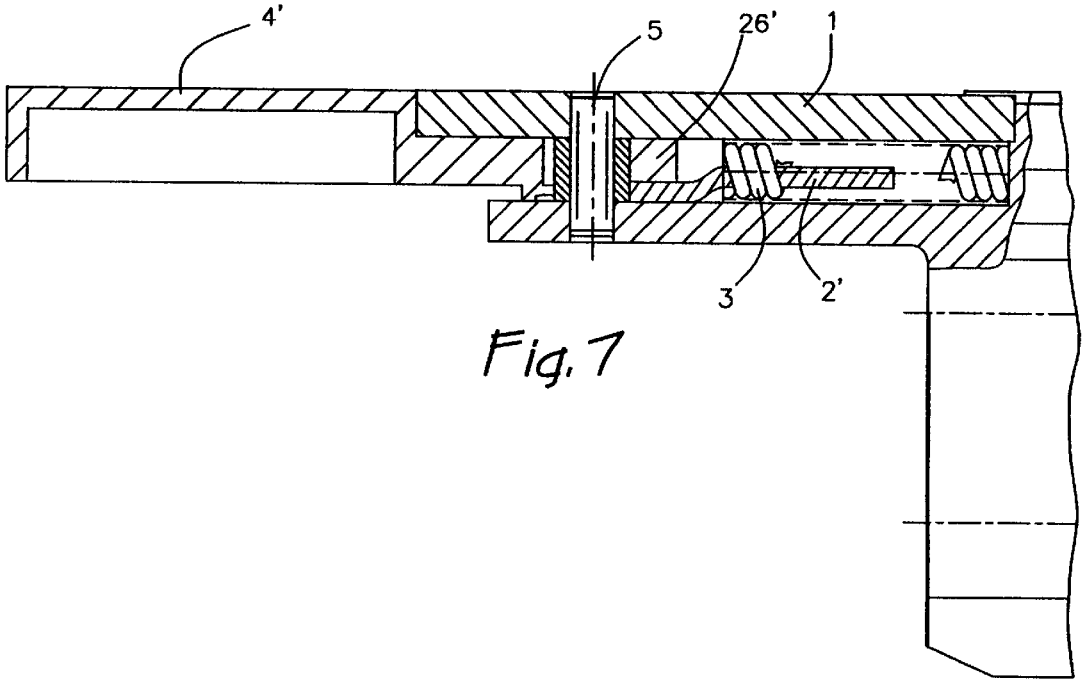
FIG. 7 is a lengthwise cross sectional view of an alternative embodiment of the loading lever assembly.

In the illustrated embodiment described above, the detent mechanism (including the protrusion 10 and the stop ends 8 and 8') are formed on the lever at a horizontal plane or level lower than that of the pusher 2 and cam member 7. The reverse arrangement can be easily realized. In the embodiment with such a reverse arrangement shown in FIG. 7, the circular disk-like latch member 26' on the lever 4' lies over the pusher 2' and functions partially as a dust cover.

The embodiments illustrated above use a compressed restoring spring to provide the restoring force for returning the loading lever to its longitudinal position. In an alternative embodiment, a stretched spring may be used as to provide the restoring force. In such an arrangement, the spring is connected to the central line of the lever and mounted centrally on the mounting strip so that the spring is stretched when the loading lever is pivoted away from its longitudinal position.

In another alternative embodiment, the locations of the pivot pin and the oblong slot which pivotally connect the lever to the mounting strip are switched. More particularly, the pin is mounted on the loading lever, and the oblong slot is correspondingly formed in the mounting strip. The oblong slot is oriented such that it aligns with the lengthwise direction of the loading lever when the loading lever is in its end-of-swing position, thus allowing the lever to be thrust into the operation position.

Accordingly, a loading lever assembly meeting the aforestated objectives has been described. The assembly permits ready hand access for both a right-handed and a left-handed user of the firearm and is readily pivotable in inoperable modes of firearm operation, while being retentively engaged in either of first or second positions in operable modes.

What is claimed is:

1. A loading lever assembly for a hand-operated firearm which has a breech block or breech block carrier guided in a weapon housing for movement in a longitudinal direction of the firearm, comprising:

a mounting member attached to the breech block or breech block carrier, the mounting member including a portion protruding through the housing of the weapon;

a loading lever having a grip end and a pivot end opposite the grip end, the pivot end being pivotally connected to the mounting member to permit movement from a released position in which the loading lever extends in the longitudinal direction of the firearm toward either of first or second sides of the firearm for movement into either of first or second operative positions, the loading lever in each of the first and second operative positions extending substantially transversely to the longitudinal direction of the firearm, first and second end stops disposed on the mounting member adapted to restrict swinging movement of the loading lever when in the first and second operable positions, respectively;

a restoring element disposed to urge the loading lever toward its released position; and a detent mechanism including engagement surfaces on the loading lever and the mounting member disposed to prevent the loading lever from swinging movement when the loading lever is in either of the first or second operative positions.

2. The loading lever assembly as in claim 1, wherein the pivot end of the loading lever is connected to the mounting member by a pivot pin.

3. The loading lever assembly as in claim 2, wherein the mounting member comprises a strip extending in the longitudinal direction of the firearm.

4. The loading lever assembly as in claim 3, wherein the pivot pin is mounted on the strip and fits through a bearing bore formed in the pivot end of the loading lever.

5. The loading lever assembly as in claim 4, wherein the bearing bore is an oblong slot lengthwise aligned with the loading lever, and the pivot pin is slidably received in the oblong slot to allow lengthwise movement of the loading lever between each of the first and second operative positions and a respective one of first and second undetented positions in which the loading lever is allowed to swing toward the released position.

6. The loading lever assembly as in claim 5, wherein the pivot end of the loading lever includes a projection which extends in the lengthwise direction of the loading lever and has first and second side flanks, each of the first and second side flanks positioned for engaging a corresponding one of the first and second end stops when the loading lever is moved into a corresponding one of the first and second operation positions to prevent the loading lever from pivoting toward the released position.

7. The loading lever assembly as in claim 6, wherein both the first and second end stops engage the loading lever when the loading lever is in each of the first and second operation positions to prevent the loading lever from pivoting toward or away from the released position.

8. The loading lever assembly as in claim 3, wherein the restoring element includes a pusher received in a guide in the strip for movement in the longitudinal direction of the firearm and biased by a restoring spring, the pusher engaging a cam member on the loading lever for releasably camming the loading lever in the released position.

9. The loading lever assembly as in claim 8, wherein the guide is disposed between the first and second end stops.

10. The loading lever as in claim 8, wherein the cam member is disposed on the loading lever at a level below the projection on the pivot end.

* * * * *